US010888984B2

(12) United States Patent
Lai et al.

(10) Patent No.: US 10,888,984 B2
(45) Date of Patent: Jan. 12, 2021

(54) FASTENER DRIVING TOOL

(71) Applicant: Pao Shen Enterprises Co., Ltd., Chang Hua (TW)

(72) Inventors: Chun-Man Lai, Chang Hua (TW); Sheng-Lung Yeh, Chang Hua (TW)

(73) Assignee: Pao Shen Enterprises Co., Ltd., Chang Hua (TW)

( * ) Notice: Subject to any disclaimer, the term of this patent is extended or adjusted under 35 U.S.C. 154(b) by 202 days.

(21) Appl. No.: 15/945,051

(22) Filed: Apr. 4, 2018

(65) Prior Publication Data

US 2019/0202045 A1 Jul. 4, 2019

(30) Foreign Application Priority Data

Jan. 4, 2018 (TW) ..... 107100308 A

(51) Int. Cl.
*B25C 5/11* (2006.01)
*B25C 5/06* (2006.01)

(52) U.S. Cl.
CPC . *B25C 5/11* (2013.01); *B25C 5/06* (2013.01)

(58) Field of Classification Search
CPC ..... B25C 5/11; B25C 5/06; B25C 5/0235; B25C 5/0285; B25C 5/10
See application file for complete search history.

(56) References Cited

U.S. PATENT DOCUMENTS 4,126,260 A * 11/1978 Mickelsson ..... B25C 5/10 227/132
4,452,388 A * 6/1984 Fealey ..... B25C 5/16 227/120
5,131,580 A * 7/1992 Allman ..... B25C 1/02 227/132
5,335,839 A * 8/1994 Fealey ..... B25C 5/06 227/132
7,540,400 B2 * 6/2009 Zins ..... B25C 1/008 227/108
7,644,849 B2 * 1/2010 Tsai ..... B25C 5/11 227/129
7,665,644 B2 * 2/2010 Hu ..... B25C 5/11 227/132
8,074,854 B2 * 12/2011 Hu ..... B25C 5/11 227/130
9,770,819 B2 * 9/2017 Lam ..... B25C 5/13
(Continued)

*Primary Examiner* — Thomas M Wittenschlaeger
(74) *Attorney, Agent, or Firm* — Burris Law, PLLC

(57) ABSTRACT

A fastener driving tool includes a striking member mounted in a housing for reciprocal movement relative to a fastener striking opening, a leaf spring engaging with the striking member at an end, and having a flexible section anchored by an anchoring unit, and a press handle pivotably connected with the anchoring unit, and having an elongated guide slot in which a pivot axle is movably engaged. The press handle is pivotable from a ready position, where the anchoring unit anchors the flexible section, through an intermediate position, where the anchoring unit is moved upwardly and rearwardly to cause resilient deflection of the leaf spring and load the leaf spring with an accumulated biasing energy, to a striking position, where the anchoring unit abuts against and is counteracted upon the pivot axle or a stop peg to be disengaged from the leaf spring so as to release the biasing energy.

7 Claims, 12 Drawing Sheets

(56) References Cited

U.S. PATENT DOCUMENTS

| | | | | |
|---|---|---|---|---|
| 2008/0223902 | A1* | 9/2008 | Tsai | B25C 5/11 227/134 |
| 2011/0297725 | A1* | 12/2011 | Huang | B25C 5/11 227/120 |
| 2012/0181320 | A1* | 7/2012 | Wang | B25C 5/08 227/109 |
| 2013/0133906 | A1* | 5/2013 | Huang | B25C 5/11 173/18 |
| 2016/0059400 | A1* | 3/2016 | Wang | B25C 5/11 227/8 |
| 2017/0266799 | A1* | 9/2017 | Wang | B25C 5/1668 |
| 2019/0047130 | A1* | 2/2019 | Lai | B25C 5/0285 |

* cited by examiner

FASTENER DRIVING TOOL

CROSS-REFERENCE TO RELATED APPLICATION

This application claims priority of Taiwanese Patent Application No. 107100308, filed on Jan. 4, 2018.

FIELD

The disclosure relates to a fastener driving tool, and more particularly to a fastener driving tool using a leaf spring for urging a fastener.

BACKGROUND

Referring to FIGS. 1 and 2, a conventional spring actuated fastener driving tool 1 as disclosed in U.S. Pat. No. 5,335,839 includes a basic housing 11 defining two inclined housing windows 110, a driver 12 mounted in the housing 11 for reciprocal movement in an upper-and-lower direction, an elongated leaf spring 13 anchored at one end with respect to the housing 11 and connected at an opposite end to the driver 12 for reciprocating the driver 12, two pawls 14 spacedly arranged, carried by a lift bearing 18 that is journalled in two slide members 15, and configured to act in latched engagement with the leaf spring 13, a handle 16 pivotably mounted to the housing 11 about a fixed axis 19 and having an arcuate slot 161 for slidable engagement with the lift bearing 18, and two return springs 17 mounted in the housing 11 for biasing the pawls 14 into engagement with the leaf spring 13. The slide members 15 are slidably confined in the respective inclined housing windows 110.

With reference to FIGS. 2 to 4, the handle 16 is pivotable about the fixed axis 19 by a manual press force applied thereon through a successive driving cycle including: a rest position (see FIG. 2) at which each slide member 15 is received in a bottom end of the respective housing window 110 and the lift bearing 18 is located at a forward end of the arcuate slot 161; an intermediate position (see FIG. 3) acting through the lift bearing 18 upwardly and rearwardly moved with the slide members 15 and the pawls 14 to resiliently deflect and load the leaf spring 13 and a counteracting extension 141 of each pawl 14 abutting against a peg 162 of the handle 16; and a release position (see FIG. 4) at which the pawls 14 are disengaged from the leaf spring 13 and the leaf spring 13 is thus freed to resiliently return the driver 12 downwardly to eject a fastener.

Through a movement of the slide members 15 in the inclined housing windows 110 and a movement of the lift bearing 18 in the arcuate slot 161 during rotation of the handle 16 from the rest position to the release position, the leaf spring 13 is resiliently deflected to accumulate a sufficient biasing energy, and the lift bearing 18 is gradually moved toward the fixed axis 19 to shorten the length of the resistance arm for reducing the force required to operate the handle 16. However, with the assemblies of the slide members 15 and the inclined housing windows 110, and of the lift bearing 18 and the pawls 14, the fastener driving tool 1 has a complicated structure, thereby resulting in higher manufacturing and assembling costs and inconvenience during assembling.

SUMMARY

Therefore, an object of the disclosure is to provide a fastener driving tool which has a simple construction that is easy to fabricate at a relatively low manufacturing cost and that is operable with less effort.

According to the disclosure, a fastener driving tool includes a housing, a striking member, an elongated leaf spring, an anchoring unit and a press handle. The housing has a pivot axle, a torque forming axle disposed rearwardly of the pivot axle, and a fastener striking opening at a forward end of the housing. The striking member is mounted in the housing for reciprocal movement in an upper-and-lower direction. The striking member has a lower striking end which faces the fastener striking opening, and an upper driven end which is formed with an engaged slot. The leaf spring is disposed in the housing, and has an engaging end which engages with the engaged slot, and a flexible section which extends rearwardly from the engaging end. The anchoring unit is disposed to releasably anchor the flexible section. The press handle is pivotably mounted in the housing, and has a forward resisting end which is pivotably connected with the anchoring unit about a connecting axis, a rearward effort end which is opposite to the forward resisting end, an elongated guide slot which is interposed between the forward resisting end and the rearward effort end and in which the pivot axle is movably engaged, and a fulcrum portion which is disposed rearwardly of the elongated guide slot and in proximity to the torque forming axle. The press handle may further have a stop peg which is disposed downwardly of the elongated guide slot.

The press handle is configured to be pivotally movable relative to the pivot axle from a ready position, where the lower striking end of the striking member is in close proximity to the fastening striking opening and the anchoring unit anchors the flexible section, through an intermediate position, where, through a moving engagement of the fulcrum portion with the torque forming axle, the anchoring unit is moved upwardly and rearwardly through the forward resisting end to cause resilient deflection of the leaf spring and load the leaf spring with an accumulated biasing energy for the striking member, to a striking position, where the anchoring unit abuts against and is counteracted upon either the pivot axle or the stop peg to be disengaged from the leaf spring, and the leaf spring is thus freed to release the biasing energy to move the lower striking end of the striking member downward toward the fastener striking opening.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
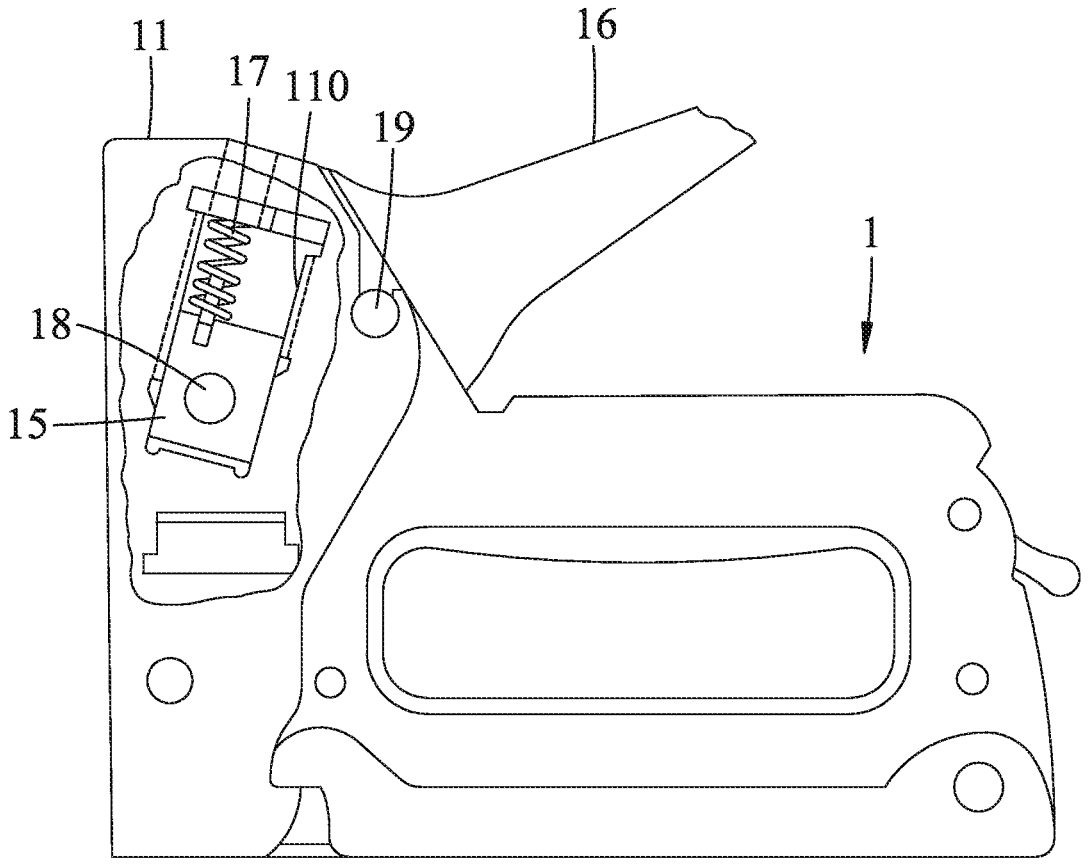
FIG.1 PRIOR ART
FIG. 1 is a schematic view of a conventional spring actuated fastener driving tool.
Figure 2:
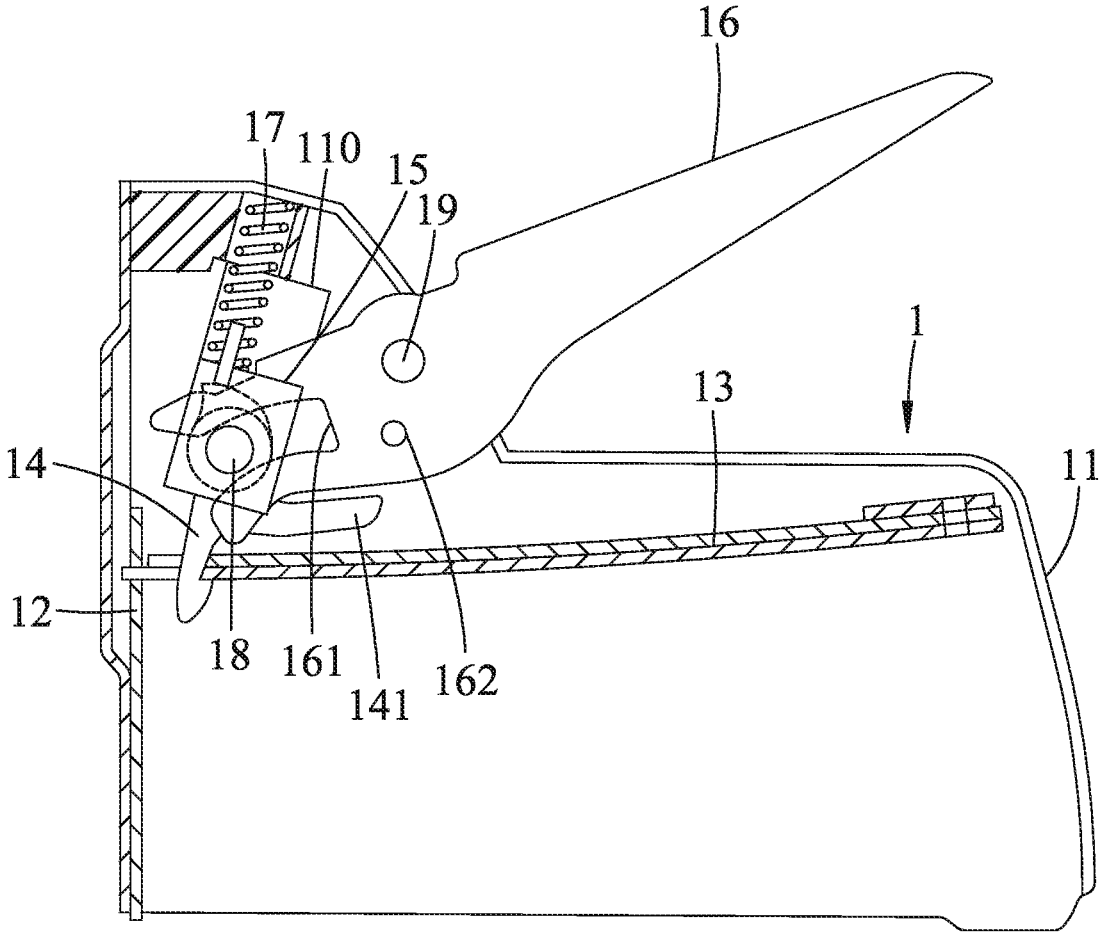
FIG.2 PRIOR ART
FIGS. 2 to 4 are schematic views illustrating the conventional fastener driving tool during various phases of a fastener driving cycle.
Figure 3:
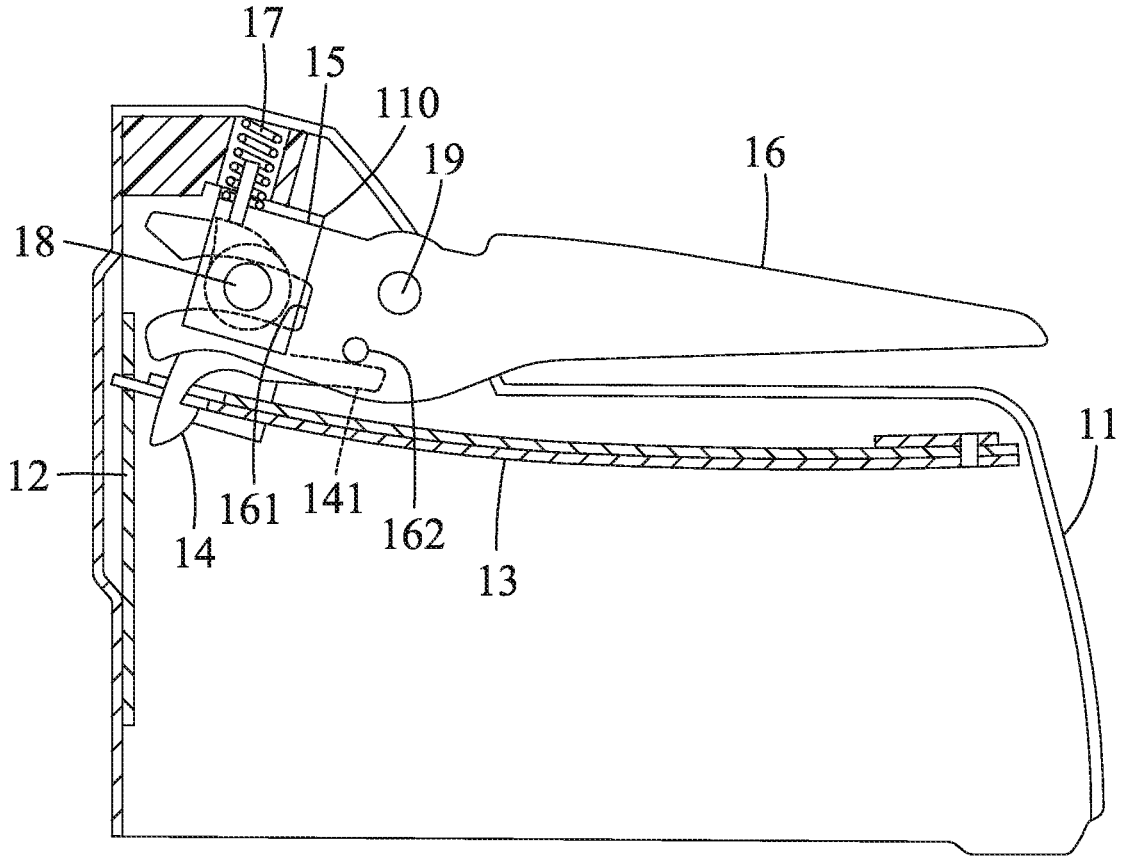
FIG.3 PRIOR ART
Figure 4:
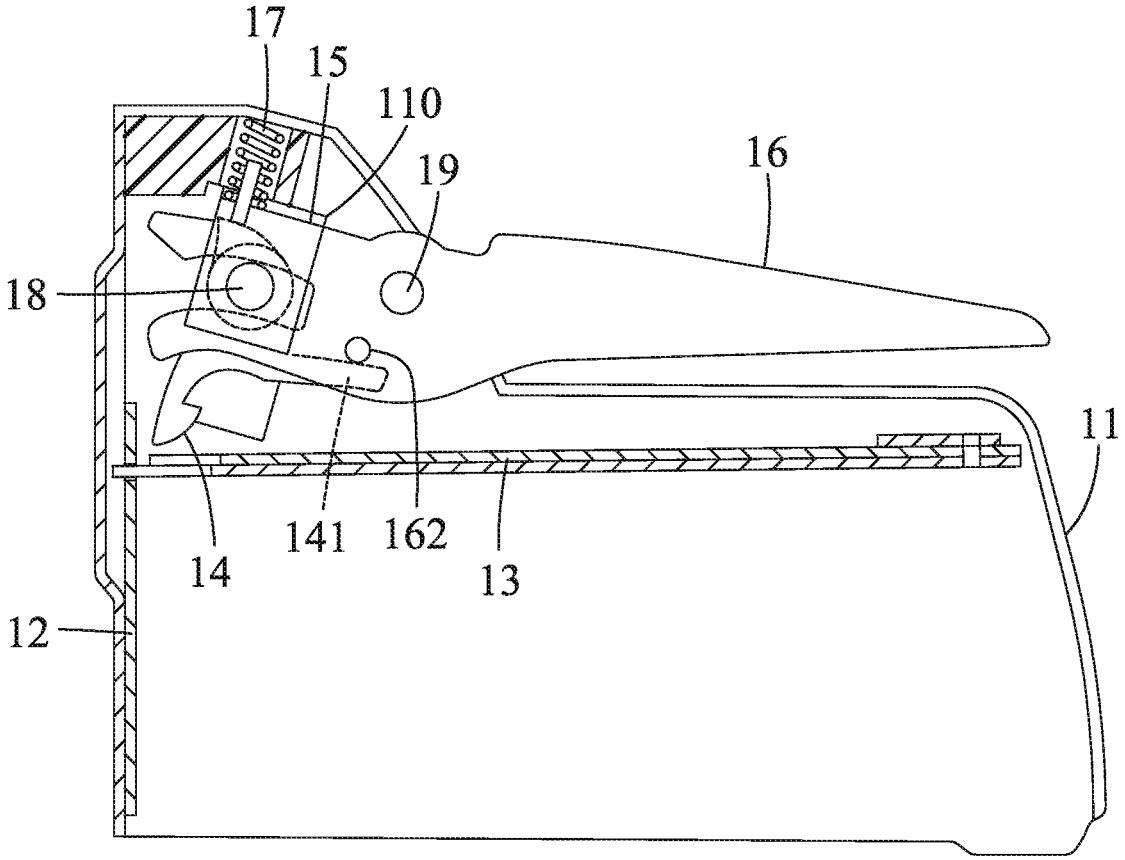
FIG.4 PRIOR ART

Before the disclosure is described in greater detail, it should be noted that where considered appropriate, reference numerals or terminal portions of reference numerals have been repeated among the figures to indicate corresponding or analogous elements, which may optionally have similar characteristics.

Figure 5:
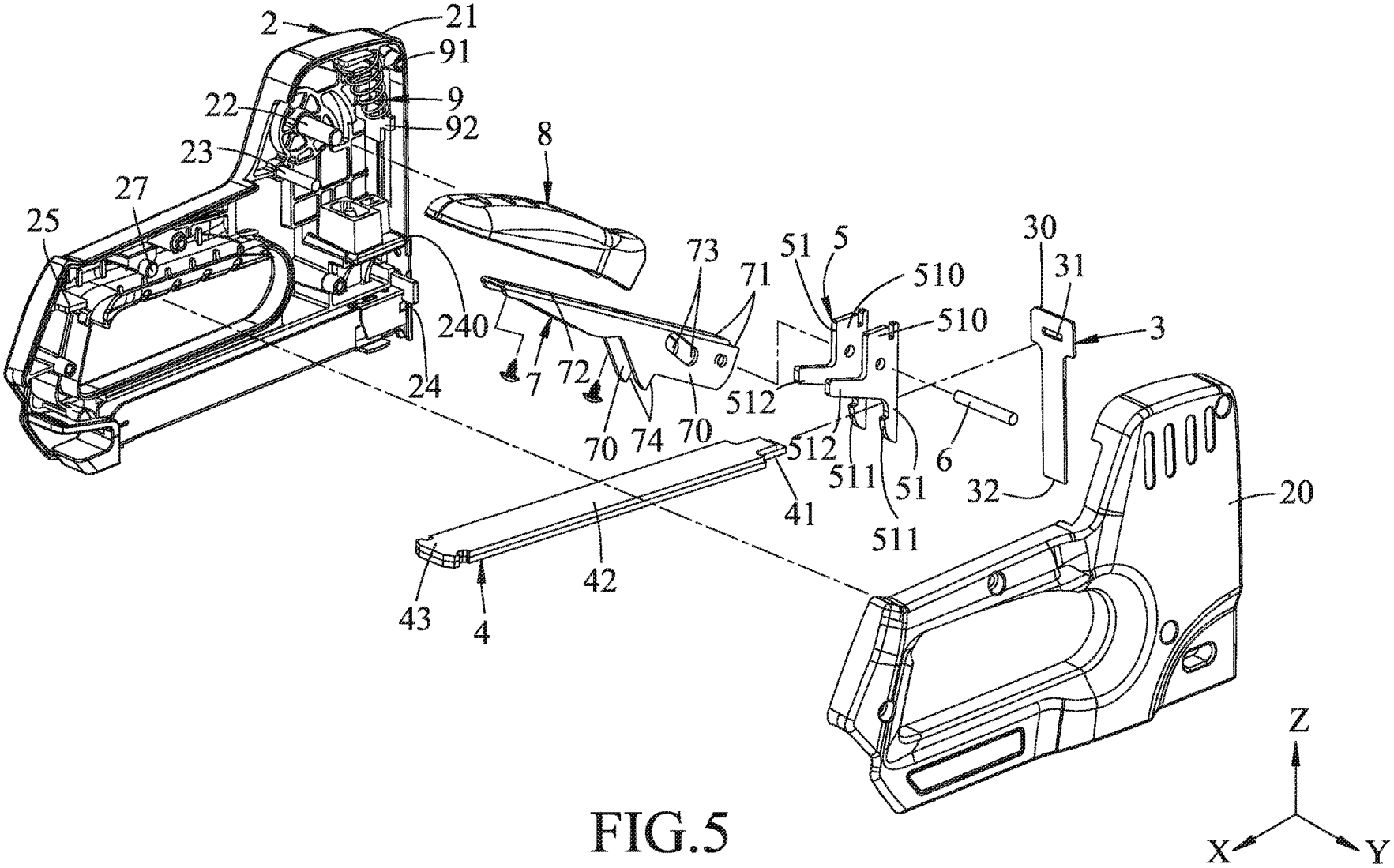
FIG. 5 is an exploded perspective view illustrating an embodiment of a fastener driving tool according to the disclosure.
Figure 6:
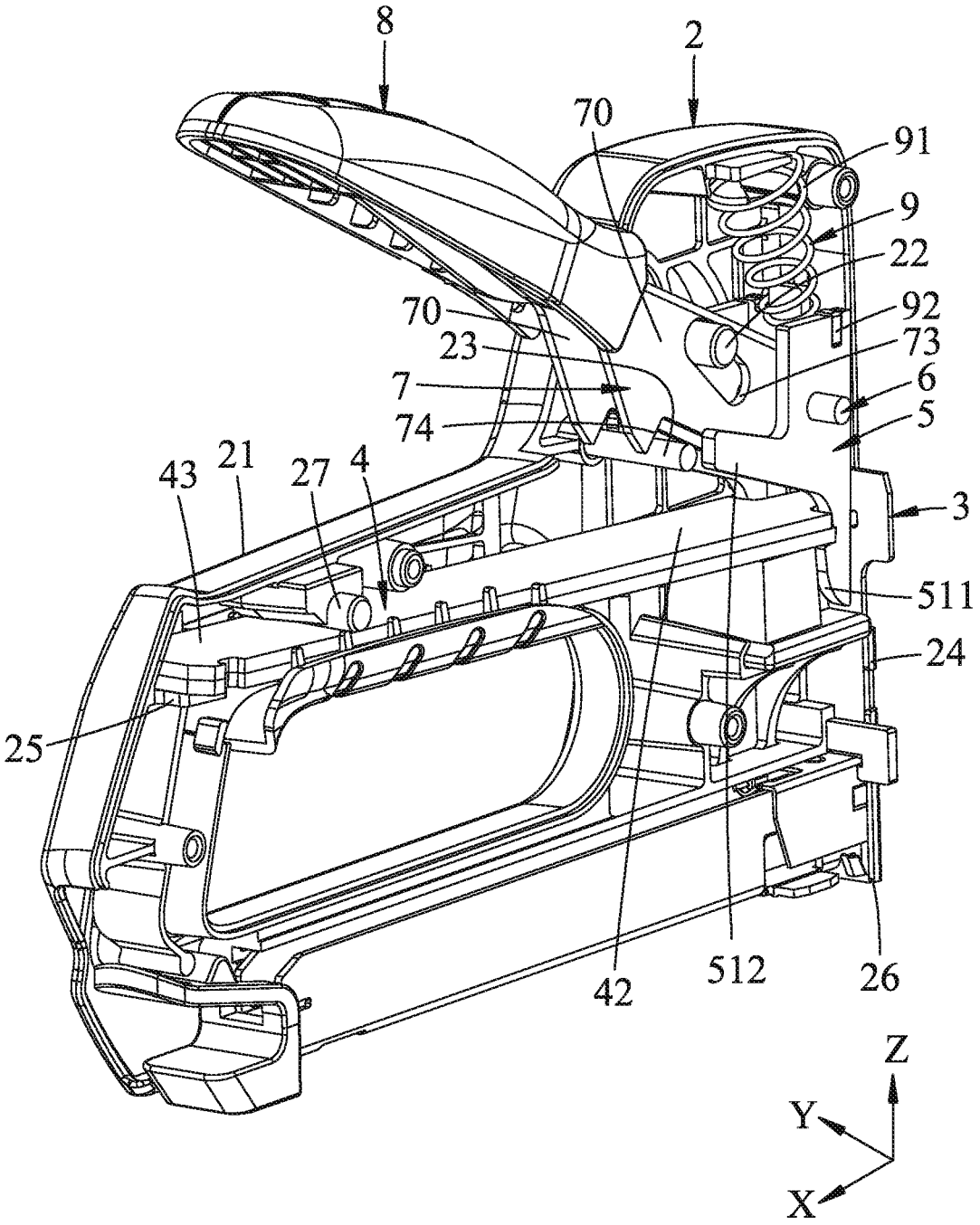
FIG. 6 is a perspective view of the embodiment, a housing half thereof being removed for the sake of clarity.
Figure 7:
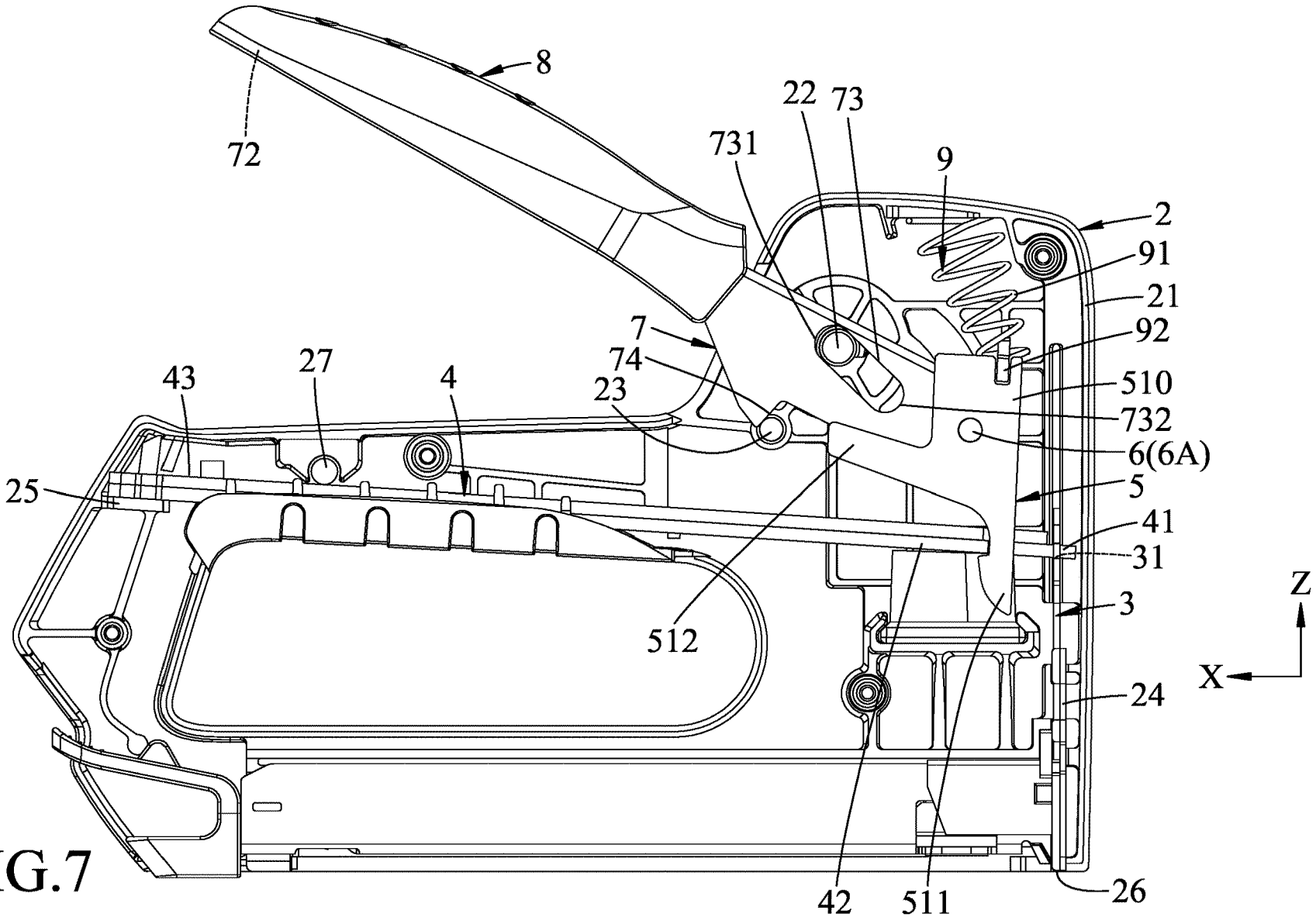
FIGS. 7 to 10 are schematic side views illustrating the embodiment during various phases of a fastener driving cycle.

Referring to FIGS. 5 to 7, an embodiment of a fastener driving tool according to the disclosure is shown to include a housing 2, a striking member 3, an elongated leaf spring 4, an anchoring unit 5, a press handle 7, a handle sleeve 8 and a return biasing unit 9.

The housing 2 includes two housing halves 20, 21 coupled to each other. The housing 2 has a pivot axle 22 secured to the housing half 21, a torque forming axle 23 secured to the housing half 21 and disposed rearwardly and downwardly of the pivot axle 22 and parallel to the pivot axle 22 in a left-and-right direction (Y), a guiding member 24 disposed at a lower and forward end of the housing 2 to define a striking track 240 in an upper-and-lower direction (Z), a support member 25 disposed on the housing half 21 and rearwardly of the torque forming axle 23, a fastener striking opening 26 formed at a lowermost end of the striking track 240, and a press member 27 disposed between the torque forming axle 23 and the support member 25 in a front-and-rear direction (X). In this embodiment, the support member 25 is in the form of a rib integrally formed with the housing half 21.

The striking member 3 is mounted in the guiding member 24 for reciprocal movement along the striking track 240 in the upper-and-lower direction (Z). The striking member 3 has a lower striking end 32 which faces the fastener striking opening 26, and an upper driven end 30 which is formed with an engaged slot 31. In a different embodiment, the guiding member 24 may be dispensed with so that the housing 2 is formed with a striking track 240 therein.

The leaf spring 4 is disposed in the housing 2, and has an engaging end 41 which engages with the engaged slot 31 of the striking member 3, a flexible section 42 which extends rearwardly from the engaging end 41, and a supported end 43 which is opposite to the engaging end 41 and which is supported on the support member 25 and pressed by the press member 27 so as to be held firmly in the housing 2. In this embodiment, the flexible section 42 has a width larger than that of the engaging end 41.

The anchoring unit 5 is disposed to releasably anchor the flexible section 42 of the leaf spring 4. In this embodiment, the anchoring unit 5 includes two anchoring plates 51 spaced apart from each other in the left-and-right direction (Y) and pivotably mounted to the press handle 7 by means of a connecting axle 6 that extends along a connecting axis. Each anchoring plate 51 has an anchoring portion 511, a counteracting portion 512 and a radially offset portion 510 angularly displaced from one another about the connecting axis 6A of the connecting axle 6. The anchoring portions 511 of the anchoring plates 51 are disposed to releasably anchor the flexible section 42 of the leaf spring 4. Alternatively, the anchoring unit 5 may have only one anchoring plate 51, the anchoring portion 511 of which releasably anchors the flexible section 42 of the leaf spring 4.

The press handle 7 is pivotably mounted in the housing 2, and has a forward resisting end 71 which is pivotably connected with the anchoring plates 51, a rearward effort end 72 which is opposite to the forward resisting end 71, two elongated guide slots 73 which are interposed between the forward resisting end 71 and the rearward effort end 72 and in which the pivot axle 22 is movably engaged, and two fulcrum portions 74 which are disposed rearwardly of the elongated guide slots 73 and in proximity to the torque forming axle 23. Each elongated guide slot 73 extends angularly about the torque forming axle 23 to have first and second ends 731, 732 that are remote from and proximate to the forward resisting end 71, respectively. Specifically, in this embodiment, the press handle 7 includes two side major walls 70 which are arranged to be spaced apart from each other in the left-and-right direction (Y) and disposed laterally and inwardly of the anchoring plates 51, respectively, and each of which has the elongated guide slot 73 and the fulcrum portion 74. Alternatively, the side major walls 70 may be integrally formed as a single piece to have one elongated guide slot 73 and one fulcrum portion 74.

The handle sleeve 8 is mounted on the press handle 7 to cover the rearward effort end 72 for offering a comfortable press operation.

The return biasing unit 9 is disposed for biasing the anchoring unit 5 into engagement with the flexible section 42 of the leaf spring 4. Specifically, the return biasing unit 9 includes a connecting plate 92 which is mounted on the radially offset portions 510 of the anchoring plates 51, and a biasing spring 91 which is disposed between an upper inner edge of the housing 2 and the connecting plate 92. In this embodiment, the biasing spring 91 is a compression spring and extends substantially in the upper-and-lower direction (Z) to bias the radially offset portions 510 downwardly so as to bias the anchoring portions 511 into engagement with the flexible section 42.

Figure 8:
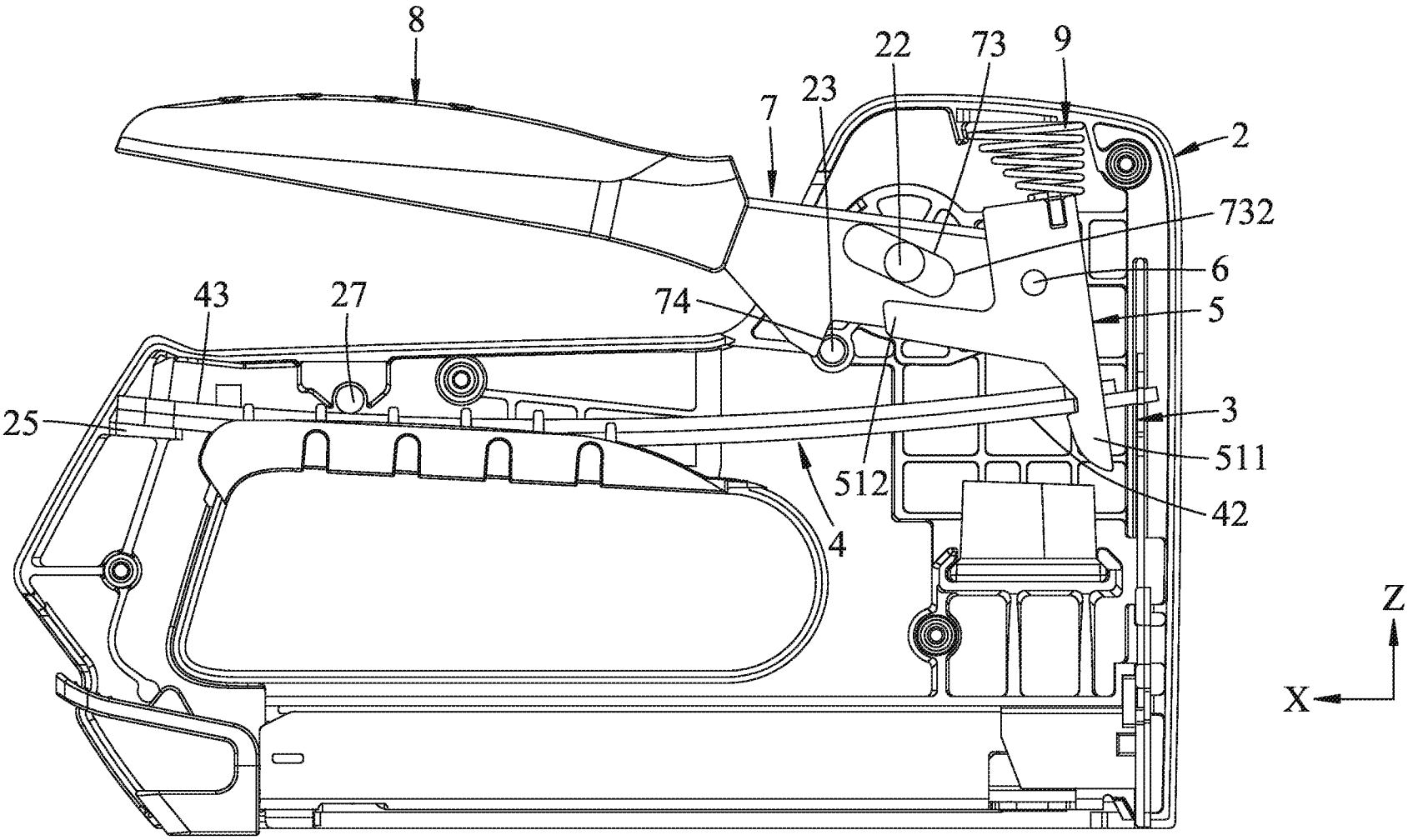
Figure 9:
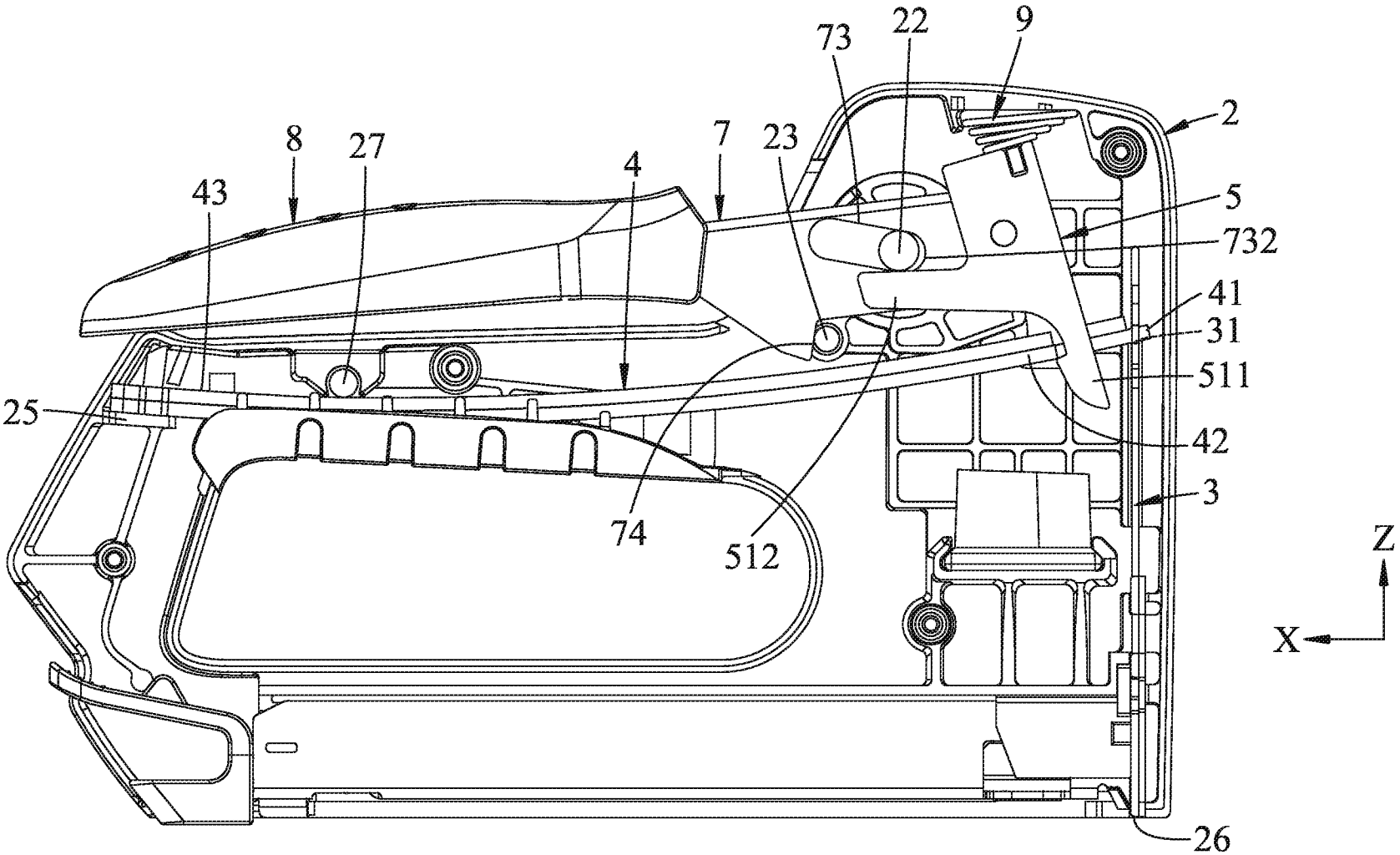

With reference to FIGS. 7 to 9, the press handle 7 is pivotally movable relative to the pivot axle 22 between a ready position (see FIG. 7) and a striking position (see FIG. 9). As shown in FIG. 7, in the ready position, the first end 731 of each elongated guide slot 73 is in proximity to the pivot axle 22, each fulcrum portion 74 is engaged with the torque forming axle 23, the lower striking end 32 (see FIG. 5) of the striking member 3 is in close proximity to the fastening striking opening 26, the anchoring portions 511 of the anchoring unit 5 anchor the flexible section 42, and the radially offset portions 510 are disposed upwardly of the anchoring portions 511. As shown in FIG. 8, in an intermediate position, through a turning abutment of the fulcrum portions 74 against the torque forming axle 23 during the pivotal movement of the press handle 7, and the relative movement of the elongated guide slots 73 to the pivot axle 22 to move the second ends 732 toward the pivot axle 22, the anchoring unit 5 is gradually moved upwardly and rearwardly through the forward resisting end 71 to cause resilient deflection of the leaf spring 4 and load the leaf spring 4 with an accumulated biasing energy for the striking member 3, and to move the striking member 3 upwardly away from the fastener striking opening 26.

Figure 10:
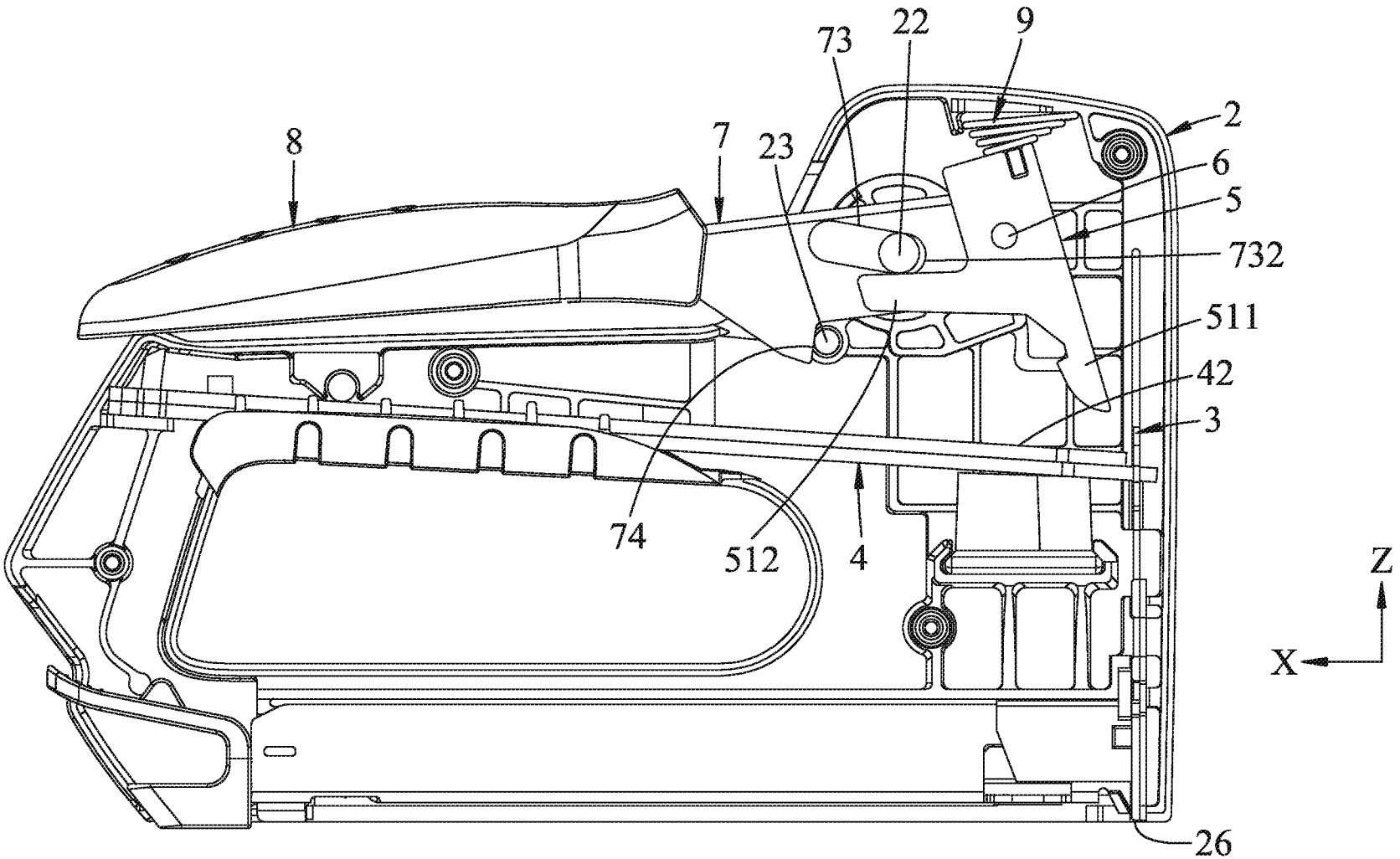

As shown in FIG. 9, when the press handle 7 is pivotally moved to almost reach the striking position, the second ends 732 are in proximity to the pivot axle 22, and the counteracting portions 512 abut against and are counteracted upon the pivot axle 22. As shown in FIG. 10, when the press handle 7 is in the striking position, with the pivotal engagements between each fulcrum portion 74 and the torque forming axle 23, and between each counteracting portion 512 and the pivot axle 22, a continued pivotal movement of the press handle 7 brings a pivotal movement of the anchoring unit 5 about the connecting axis 6A so as to disengage the anchoring portions 511 from the leaf spring 4, and the leaf spring 4 is thus freed to release the biasing energy to move the lower striking end 32 of the striking member 3 downward toward the fastener striking opening 26. When the press handle 7 is in this striking position, the biasing spring 91 is compressed to have a biasing action to return the press handle 7 to the ready position.

With reference to FIGS. 7 and 8, in use, the rearward effort end 72 of the press handle 7 is pressed downward to pivot the handle 7 from the ready position toward the striking position. During the fastener driving cycle, the press handle 7 is slightly moved rearward to bring the second ends 732 of the elongated guide slots 73 into movement toward the pivot axle 22. With the turning and movement of the press handle 7, the anchoring unit 5 can be moved upwardly and rearwardly to urge the striking member 3 to move upward through the leaf spring 4. During this stage, the press handle 7 is gradually moved rearward to increase the length of power arm thereof so as to be operable with less effort. At this time, the leaf spring 4 is resiliently deflected to accumulate a biasing energy, and the biasing spring 91 is compressed to store a return biasing force.

With reference to FIG. 9, once the press handle 7 almost reaches the striking position, the counteracting portions 512 abut against and are counteracted upon the pivot axle 22. The press handle 7 is moved rearward to permit the anchoring unit 5 to be disengaged from the flexible section 42 of the leaf spring 4. Subsequently, with reference to FIG. 10, once the disengagement occurs, the leaf spring 4 is unloaded to fire the striking member 3 downward to the fastener striking opening 26 for performing a fastener striking stroke.

Finally, the press handle 7 is released from the user, and is returned to the ready position by means of the biasing spring 91.

Figure 11:
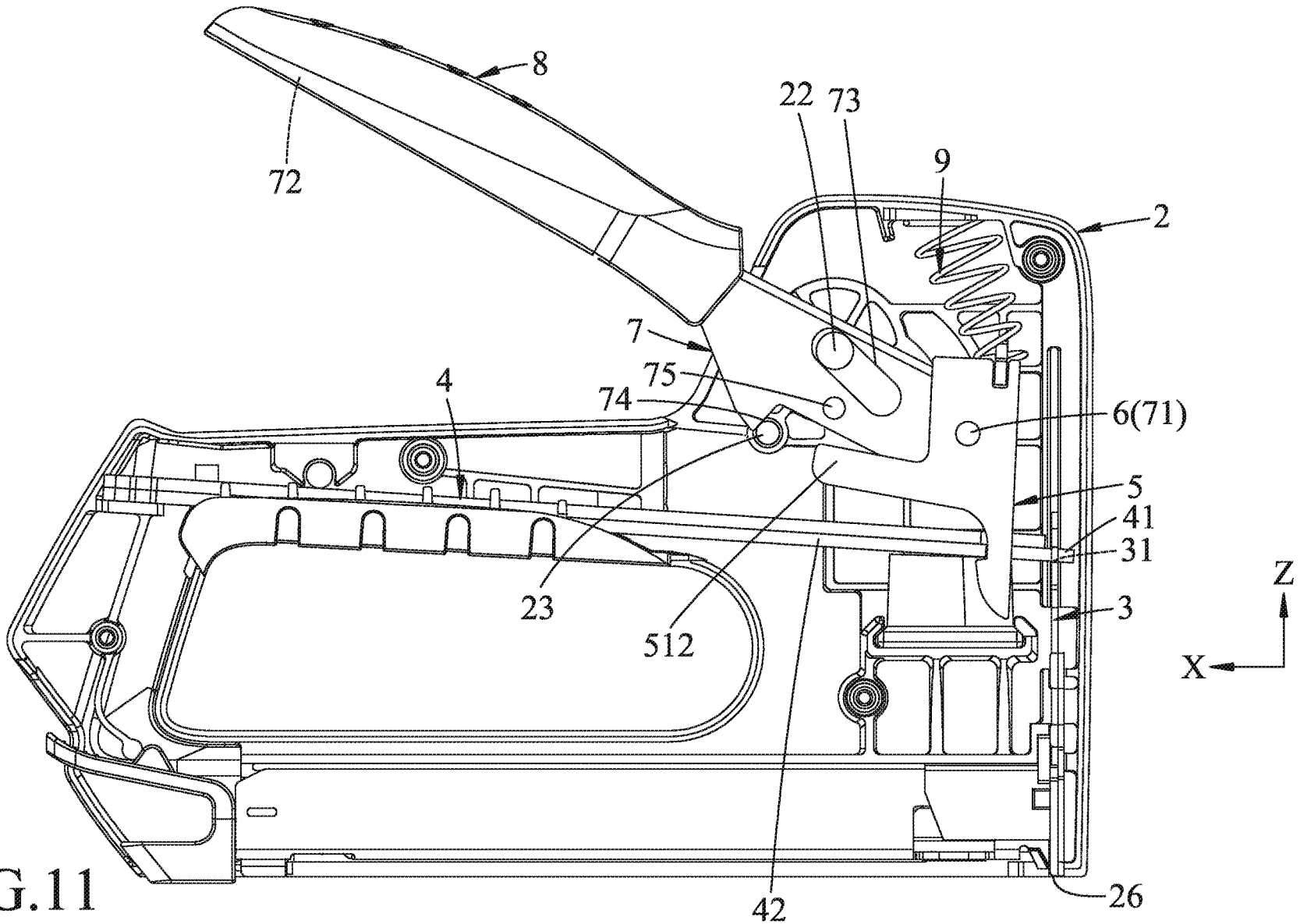
FIG. 11 is a schematic side view illustrating another embodiment of a fastener driving tool according to the disclosure.
Figure 12:
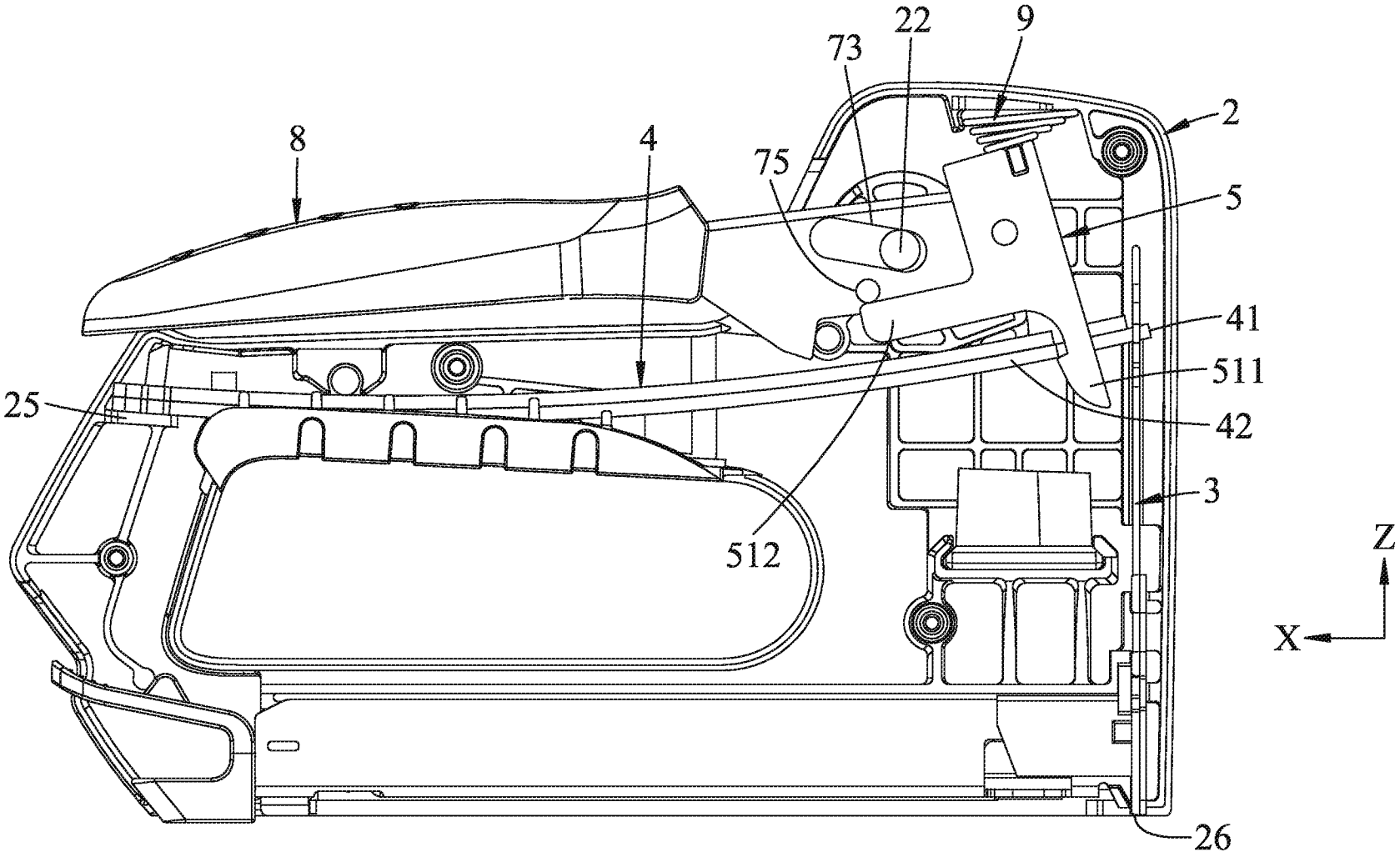
FIG. 12 is a schematic side view illustrating another embodiment during a phase of a fastener driving cycle.

Referring to FIGS. 11 and 12, in another embodiment, the press handle 7 has a stop peg 75 which is disposed downwardly of the elongated guide slots 73. When the press handle 7 is pivotally moved to reach the striking position, the counteracting portions 512 of the anchoring unit 5 abut against and are counteracted upon the stop peg 75 such that the anchoring unit 5 is moved and turned to be disengaged from the leaf spring 4, and the leaf spring 4 is thus freed to release the biasing energy thereof to move the striking member 3 downward toward the fastener striking opening 26.

As illustrated, in the disclosure, with the anchoring unit 5 pivotally mounted on the press handle 7, and the elongated guide slots 73 formed in the press handle 7 to be slidably engaged with the pivot axle 22, the length of the power arm (i.e. the distance between the rearward effort end 72 and the pivot axle 22) can be increased during the fastener driving cycle, rendering the operation of the press handle 7 effortless. The fastener driving tool of the disclosure has a fewer number of components, thereby reducing the manufacturing cost and rendering the fabrication easy. Additionally, with the pivotal engagement between each fulcrum portion 74 and the torque forming axle 23, and the sliding engagement between each elongated guide slot 73 and the pivot axle 22, the press handle 7 can be rotated and moved rearward to increase the length of power arm so as to be operable with less effort. Furthermore, with the counteracting portions 512 of the anchoring unit 5 abutting against and counteracted upon either the pivot axle 22 or the stop peg 75 once the press handle 7 is pivoted to reach the striking position, the anchoring unit 5 can be moved and turned to be disengaged from the leaf spring 4, the anchoring unit 5 can be moved smoothly and steadily to be disengaged from the leaf spring 4, and the leaf spring 4 can be thus freed to release the biasing energy for striking a fastener.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A fastener driving tool comprising:

a housing having a pivot axle, a torque forming axle disposed rearwardly of said pivot axle, and a fastener striking opening at a forward end of said housing;

a striking member mounted in said housing for reciprocal movement along a striking axis in an upper-and-lower direction, said striking member having a lower striking end which faces said fastener striking opening, and an upper driven end which is formed with an engaged slot;

an elongated leaf spring disposed in said housing and having an engaging end which engages with said engaged slot, and a flexible section which extends rearwardly from said engaging end;

an anchoring unit releasably anchoring said flexible section; and a press handle pivotably mounted in said housing, and having a forward resisting end which is pivotably connected with said anchoring unit about a connecting axis, a rearward effort end which is opposite to said forward resisting end, an elongated guide slot which is interposed between said forward resisting end and said rearward effort end and in which said pivot axle is movably engaged, and a fulcrum portion which is disposed rearwardly of said elongated guide slot and in proximity to said torque forming axle, said press handle being configured to be pivotally movable relative to said pivot axle from a ready position, where said lower striking end of said striking member is in close proximity to said fastening striking opening and said anchoring unit anchors said flexible section, through an intermediate position, where, through a moving engagement of said fulcrum portion with said torque forming axle, said anchoring unit is moved upwardly and rearwardly through said forward resisting end to cause resilient deflection of said leaf spring and load said leaf spring with an accumulated biasing energy for said striking member, to a striking position, where said anchoring unit abuts against and is counteracted upon said pivot axle to be disengaged from said leaf spring, and said leaf spring is freed to release the biasing energy to move said lower striking end of said striking member downward toward said fastener striking opening.

2. The fastener driving tool as claimed in claim 1, wherein said fulcrum portion is engaged with said torque forming axle when said press handle is in the ready position.

3. The fastener driving tool as claimed in claim 2, wherein said elongated guide slot extends to have first and second ends that are remote from and proximate to said forward resisting end, respectively, such that said first end is in proximity to said pivot axle when said press handle is in the ready position, and said second end is in proximity to said pivot axle when said press handle is in the striking position.

4. The fastener driving tool as claimed in claim 1, wherein said anchoring unit has an anchoring portion which is disposed to releasably anchor said flexible section of said leaf spring, and a counteracting portion which is spaced apart from said anchoring portion and which abuts against and is counteracted upon said pivot axle when said press handle is in the striking position to pivotally move said anchoring unit about the connecting axis so as to disengage said anchoring portion from said leaf spring.

5. The fastener driving tool as claimed in claim 1, wherein said flexible section of said leaf spring has a width larger than that of said engaging end.

6. The fastener driving tool as claimed in claim 1, further comprising a return biasing unit which is disposed for biasing said anchoring unit into engagement with said flexible section of said leaf spring.

7. The fastener driving tool as claimed in claim 6, wherein said anchoring unit has an anchoring portion which is disposed to releasably anchor said flexible section of said leaf spring, a counteracting portion which is spaced apart from said anchoring portion and which abuts against and is counteracted upon said pivot axle when said press handle is in the striking position, and a radially offset portion which is spaced apart from said anchoring and counteracting portions and which is disposed upwardly of said anchoring portion when said press handle is in the ready position, said return biasing unit including a connecting plate which is mounted on said radially offset portion, and a biasing spring which is disposed between an upper inner edge of said housing and said connecting plate.

* * * * *